US010822808B2

(12) United States Patent
Cappelle

(10) Patent No.: US 10,822,808 B2
(45) **Date of Patent: *Nov. 3, 2020**

(54) FLOOR PANEL FOR FORMING A FLOOR COVERING

(71) Applicant: FLOORING INDUSTRIES LIMITED, SARL, Bertrange (LU)

(72) Inventor: Mark Cappelle, Staden (BE)

(73) Assignee: FLOORING INDUSTRIES LIMITED, SARL, Bertrange (LU)

( * ) Notice: Subject to any disclaimer, the term of this patent is extended or adjusted under 35 U.S.C. 154(b) by 0 days.

This patent is subject to a terminal disclaimer.

(21) Appl. No.: 16/457,299

(22) Filed: Jun. 28, 2019

(65) Prior Publication Data

US 2019/0323243 A1 Oct. 24, 2019

Related U.S. Application Data

(63) Continuation of application No. 15/514,284, filed as application No. PCT/IB2015/057389 on Sep. 25, 2015, now Pat. No. 10,337,191.

(60) Provisional application No. 62/055,809, filed on Sep. 26, 2014.

(51) Int. Cl.
*E04F 15/02* (2006.01)
*E04F 15/10* (2006.01)

(52) U.S. Cl.
CPC ..... *E04F 15/02038* (2013.01); *E04F 15/10* (2013.01); *E04F 15/105* (2013.01); *E04F 15/107* (2013.01); *E04F 2201/0146* (2013.01); *E04F 2201/0184* (2013.01); *E04F 2201/041* (2013.01)

(58) Field of Classification Search
CPC . E04F 15/02038; E04F 15/107; E04F 15/105; E04F 15/10; E04F 2201/041; E04F 2201/0184; E04F 2201/0146
USPC ..... 52/588.1, 589.1, 591.1, 591.3
See application file for complete search history.

(56) References Cited

U.S. PATENT DOCUMENTS

| | | | |
|---|---|---|---|
| 6,591,568 | B1 | 7/2003 | Pålsson |
| 6,647,690 | B1 | 11/2003 | Martensson |
| 6,854,235 | B2 | 2/2005 | Martensson |
| 7,332,053 | B2 | 2/2008 | Palsson et al. |
| 7,896,571 | B1 | 3/2011 | Hannig et al. |
| 7,980,043 | B2 | 7/2011 | Moebus |
| 8,353,140 | B2 | 1/2013 | Pervan et al. |

(Continued)

FOREIGN PATENT DOCUMENTS

| | | | |
|---|---|---|---|
| EP | 1614829 | A2 | 1/2006 |
| EP | 2339092 | A1 | 6/2011 |

(Continued)

OTHER PUBLICATIONS

International Search Report from PCT Application No. PCT/IB2015/057389, dated Jan. 12, 2016.

*Primary Examiner* — Brent W Herring
(74) *Attorney, Agent, or Firm* — Workman Nydegger

(57) ABSTRACT

A floor panel for forming a floor covering, wherein this floor panel comprises a substrate, which substrate is manufactured on the basis of synthetic material; wherein this floor panel, on at least one pair of opposite edges, comprises coupling parts, which coupling parts allow that two such floor panels can be coupled to each other by means of a downward movement of one floor panel in respect to the other floor panel.

9 Claims, 7 Drawing Sheets

(56) References Cited

U.S. PATENT DOCUMENTS

| | | | | |
|---|---|---|---|---|
| 8,365,499 | B2 | 2/2013 | Nilsson et al. | |
| 8,375,672 | B2 * | 2/2013 | Hannig | E04F 15/02038 52/588.1 |
| 8,544,233 | B2 | 10/2013 | Palsson et al. | |
| 8,544,234 | B2 | 10/2013 | Pervan et al. | |
| 8,584,432 | B2 | 11/2013 | Braun | |
| 8,756,899 | B2 | 6/2014 | Nilsson et al. | |
| 8,806,832 | B2 | 8/2014 | Kell | |
| 9,212,492 | B2 | 12/2015 | Pervan et al. | |
| 9,217,250 | B2 | 12/2015 | Perra et al. | |
| 9,249,581 | B2 | 2/2016 | Nilsson et al. | |
| 9,316,006 | B2 | 4/2016 | Palsson et al. | |
| 9,574,354 | B2 | 2/2017 | Stevens, Jr. | |
| 9,670,683 | B2 | 6/2017 | Cappelle | |
| 10,072,428 | B2 | 9/2018 | Devos | |
| 10,337,191 | B2 * | 7/2019 | Cappelle | E04F 15/10 |
| 2002/0046528 | A1 | 4/2002 | Pervan et al. | |
| 2002/0189183 | A1 | 12/2002 | Ricciardelli | |
| 2003/0066588 | A1 | 4/2003 | Palsson et al. | |
| 2003/0094230 | A1 | 5/2003 | Sjoberg | |
| 2004/0068954 | A1 | 4/2004 | Martensson | |
| 2008/0271403 | A1 | 11/2008 | Palsson et al. | |
| 2009/0133353 | A1 | 5/2009 | Pervan et al. | |
| 2009/0249733 | A1 | 10/2009 | Moebus | |
| 2011/0094178 | A1 | 4/2011 | Braun | |
| 2011/0138722 | A1 | 6/2011 | Hannig | |
| 2011/0280655 | A1 | 11/2011 | Maertens et al. | |
| 2012/0266555 | A1 | 10/2012 | Cappelle | |
| 2013/0160391 | A1 | 6/2013 | Pervan et al. | |
| 2015/0240500 | A1 | 8/2015 | Stevens, Jr. | |
| 2016/0076260 | A1 | 3/2016 | Pervan et al. | |
| 2016/0201336 | A1 | 7/2016 | Pervan | |
| 2016/0369516 | A1 | 12/2016 | Cappelle | |
| 2017/0241136 | A1 | 8/2017 | Kell | |
| 2019/0017278 | A1 | 1/2019 | De Rick et al. | |

FOREIGN PATENT DOCUMENTS

| | | | |
|---|---|---|---|
| WO | 2010023042 | A1 | 3/2010 |
| WO | 2014033628 | A1 | 3/2014 |
| WO | 2014108875 | A1 | 7/2014 |
| WO | 2015130169 | A1 | 9/2015 |

* cited by examiner

FLOOR PANEL FOR FORMING A FLOOR COVERING

CROSS-REFERENCE TO RELATED APPLICATIONS

This application is a continuation of the U.S. non provisional application Ser. No. 15/514,284 filed on Mar. 24, 2017, which claims the benefit under 35 U.S.C. 119(e) to the U.S. provisional applications No. 62/055,809 filed on Sep. 26, 2014.

BACKGROUND OF THE INVENTION

1. Field of the Invention

This invention relates to a floor panel for forming a floor covering, as well as to a method for manufacturing a floor panel.

2. Related Art

More particularly, the invention relates to a floor panel of the type wherein the floor panel comprises a substrate, which substrate preferably is manufactured on the basis of synthetic material; wherein this floor panel, on at least one pair of opposite edges, comprises coupling parts, which coupling parts allow that two such floor panels can be coupled to each other by means of a downward movement of one floor panel in respect to the other floor panel; wherein these coupling parts allow a locking in a first direction perpendicular to the plane of the floor panel, as well as in a second direction perpendicular to the edges and in the plane of the floor panel; wherein these coupling parts substantially are formed of the material of said substrate and are made in one piece therewith; wherein these coupling parts consist of a downward-directed upper hook-shaped part, which is situated on the one edge of said pair of opposite edges, as well as of an upward-directed lower hook-shaped part, which is situated on the other, opposite edge of said pair of opposite edges, which hook-shaped parts can be engaged behind each other by means of said downward movement; and wherein the upper hook-shaped part consists of a lip which is provided with a downward-directed locking element, whereas the lower hook-shaped part consists of a lip which is provided with an upward-directed locking element. Such floor panels are known, for example, from EP 2 339 092 A1 and WO 2010/023042.

A general problem with such floor panels is that the locking in vertical direction can be weak. As a result of this weak locking, it is possible that, under the influence of temperature, the individual floor panels set up and the coupling parts separate from each other or the floor panels move out of each other, whereby gaps may be created. This is due to shrinkage and expansion, or even warping, of the floor panels under the influence of temperature. The features of the floor panels of the state of the art are such that problems may occur already with heating by incident sunlight, for example, at a window in a room.

SUMMARY OF THE DISCLOSURE

The invention primarily aims at alternative floor panels of the above-mentioned type, wherein an improved locking is provided, wherein according to various preferred embodiments a solution can be obtained for the problems with the floor panels of the state of the art. More particularly, the invention does not only aim at providing an improved locking, but also at allowing a smooth installation of the floor panels.

To this aim, the invention relates to a floor panel as described in the independent claims 1 to 4, which respectively relate to four independent aspects of the invention. All characteristics of these independent claims or aspect can be combined at choice, as far as they are not contradictory.

According to the first independent aspect, the invention relates to a floor panel of the above-mentioned type, with the characteristic that the locking elements are provided with locking surfaces which at least partially allow the locking in said first direction perpendicular to the plane of the floor panels, which locking surfaces comprise a first and second locking surface, which first locking surface belongs to a proximal side of the downward-directed locking element and which second locking surface belongs to a proximal side of the upward-directed locking element; that said locking surfaces, in the coupled condition of two such floor panels, define a tangent line forming an angle with the plane of the floor panel, which angle is smaller than 30 degrees and is larger than 0 degrees, and/or that said second locking surface defines such angle; and that said locking surfaces extend continuously over the major part of the length of the respective edges.

As the locking surfaces form a rather small angle with the plane of the floor panel, the advantage is obtained that the vertical locking between the coupled floor panels can be made extremely strong. Moreover, this strong locking can be provided over the major part of the edges, as the locking surfaces extend continuously over the major part of the length of the edges. It is also noted that by the "major part" of the length of the edges at least 50%, preferably at least 75% and still more preferably at least 90% of the length of the respective edges is intended. The strong locking allows minimizing the risk of the occurrence of gaps, for example, as a result of the setting up of the floor panels under the influence of temperature.

That the locking surfaces which at least partially provide for the vertical locking are situated on said proximal sides of the locking elements, offers the advantage that the floor panels can be coupled in a smooth manner. This location in fact allows a smooth deformation of the coupling parts during coupling of the floor panels. That the coupling parts can deform, can be effected by manufacturing the substrate on the basis of synthetic material. Synthetic material namely allows a certain elastic deformation, such as bending and/or compressing actions, in particular when this is the synthetic material of the supple type.

According to the second independent aspect, the invention relates to a floor panel of the above-mentioned type, with the characteristic that the locking elements are provided with locking surfaces which at least partially allow the locking in said first direction perpendicular to the plane of the floor panels, which locking surfaces comprise a first and second locking surface, which first locking surface belongs to a proximal side of the downward-directed locking element and which second locking surface belongs to a proximal side of the upward-directed locking element; that said locking surfaces, in the coupled condition of two such floor panels, define a tangent line forming an angle with the plane of the floor panel, which angle is smaller than 90 degrees, and/or that said second locking surface defines such angle; and that said coupling parts are configured such that, in the coupled condition of two such floor panels, at least in said first direction perpendicular to the plane of the floor panel a tensioning force is present at the location of the locking surfaces, and/or that at least in said second direction perpendicular to the edges and in the plane of the floor panel a tensioning force is present at the location of a vertical closing surface formed between the two floor panels.

As already mentioned in respect to the first aspect, the location of the locking surfaces offers the advantage that the floor panels can be installed in a smooth manner. In fact, the location allows a smooth deformation of the coupling parts during the coupling of the floor panels. That the coupling parts can deform, can be effected by manufacturing the substrate on the basis of synthetic material. To wit, synthetic material allows a certain elastic deformation, such as bending and/or compressing actions, in particular when the synthetic material is of the supple type.

The strong locking is effected here in that the locking surfaces can define an undercut, as well as also in that the mentioned tensioning force is present. The synergy between both results in a particularly close connection between the mutually coupled floor panels, by which a possible gap formation can be counteracted. Moreover, the mentioned tensioning force allows to at least partially accommodate tolerances which occur, for example, by means of milling treatments, during manufacturing of the coupling parts.

According to the third independent aspect, the invention relates to a floor panel of the above-mentioned type, with the characteristic that the locking elements are provided with locking surfaces which at least partially allow the locking in said first direction perpendicular to the plane of the floor panels, which locking surfaces comprise a first and second locking surface, which first locking surface belongs to a proximal side of the downward-directed locking element and which second locking surface belongs to a proximal side of the upward-directed locking element; that said locking surfaces, in the coupled condition of two such floor panels, define a tangent line forming an angle with the plane of the floor panel, which angle is smaller than 90 degrees, and/or that said second locking surface defines such angle; that the floor panel, on distal sides of the locking elements, is free from locking parts which, partially or entirely, allow a locking in an aforementioned first direction; that said locking surfaces, in the coupled condition of two such floor panels, seen in cross-section, are situated entirely in the lower half of the floor panel; and that said locking surfaces extend continuously over the major part of the length of the respective edges.

As already mentioned in respect to the first and the second aspect, the location of the locking surfaces offers the advantage that the floor panels can be installed in a smooth manner. The location, to wit, allows a smooth deformation of the coupling parts during coupling of the floor panels. That the coupling parts can deform, can be effected by manufacturing the substrate on the basis of synthetic material. To wit, synthetic material allows a certain elastic deformation, such as bending and/or compressing actions, in particular when that synthetic material is of the supple type.

Moreover, the smooth installation of the floor panels is also effected in that the distal sides of the locking elements are free from locking parts which contribute to the vertical locking.

The installation ease is still increased in that the locking surfaces are situated entirely in the lower half of the floor panel. In this way, these locking surfaces can be realized relatively compact. Moreover, such rather low location in the floor panel allows making the lip of the lower hook-shaped part at the position of the locking surfaces relatively thin. Thus, this lip can be provided with the necessary flexibility in order to allow a certain elastic deformation.

Notwithstanding that the herein above-mentioned distal sides are free from vertical locking parts, still a strong locking can be provided in that the locking surfaces define the described angle, as well as in that they extend continuously over the major part of the length of the edges.

According to the fourth independent aspect, the invention relates to a floor panel of the above-mentioned type, with the characteristic that the locking elements are provided with locking surfaces which at least partially allow the locking in said first direction perpendicular to the plane of the floor panels, which locking surfaces comprise a first and second locking surface, which first locking surface belongs to a proximal side of the downward-directed locking element and which second locking surface belongs to a proximal side of the upward-directed locking element; that said locking surfaces, in the coupled condition of two such floor panels, define a tangent line forming an angle with the plane of the floor panel, which angle is smaller than 90 degrees, and/or that said second locking surface defines such angle; that the downward-directed locking element comprises a protrusion, whereof, in the coupled condition of two such floor panels, at least a portion is situated beyond a vertical tangent line, which vertical tangent line touches the upward-directed locking element in a most proximally situated point of this upward-directed locking element; that the maximum height of said portion is at least ⅕ of the maximum thickness of the downward-directed locking element and maximum ¼ of this maximum thickness; that the horizontal distance between said most proximally situated point of the upward-directed locking element and the edge of the floor panel is larger than the vertical distance between the upper side of the floor panel and the most downward-situated point of the lip of the lower hook-shaped part, and that said locking surfaces extend continuously over the major part of the length of the respective edges of the floor panel.

As already stated in respect to the first, the second and the third aspect, the location of the locking surfaces offers the advantage that the floor panels can be installed in a smooth manner. The location, to wit, allows a smooth deformation of the coupling parts during coupling of the floor panels. That the coupling parts can deform, can be effected by manufacturing the substrate on the basis of synthetic material. To wit, synthetic material allows a certain elastic deformation, such as bending and/or compressing actions, in particular when that synthetic material is of the supple type.

In that the locking surfaces define the described angle, as well as in that they extend continuously over the major part of the edges, the advantage is obtained that a strong vertical locking can be effected. This strong vertical locking can also be effected by the deliberately chosen height of the mentioned protrusion, which is of sufficient thickness to provide for the desired locking, however, is made such that the floor panels may be coupled in a smooth manner. That the horizontal distance between the aforementioned most proximally situated point of the upward-directed locking element and the edge of the floor panel is larger than the vertical distance between the upper side of the floor panel and the most downward-directed point of the lip of the lower hook-shaped part, contributes to the strength of the locking, in view of the fact that this characteristic allows to make the downward-directed locking element extremely stable. As this downward-directed locking element can be made stable, also the advantage is created that the risk of breaking, for example, during coupling of the floor panels, can be minimized, thus, contributing to the smooth installation of the floor panels.

Said tangent line and/or the straight line through said second locking surface preferably is directed upward in the direction of a vertical, formed by a vertical closing surface, between two such floor panels in coupled condition. Still more preferably, said tangent line and/or the straight line through said second locking surface closes off said vertical through the vertical closing surface in such a manner that the intersection with this vertical is situated at maximum 2 mm, and preferably maximum 1 mm, above the upper side of the floor panel. In particular, said intersection is situated underneath the upper side of the floor panel. Such configuration of the tangent line and/or the straight line through the second locking surface allows a particularly strong vertical locking between the coupled floor panels, whereas the floor panels still can be coupled to each other in a smooth manner.

On a distal side of the downward-directed locking element, the floor panel can be free from locking parts which partially or entirely allow a locking in an aforementioned first direction. This increases the installation ease of the floor panels. With the same aim, the floor panel, on a distal side of the upward-directed locking element, can be free from locking parts which partially or entirely allow a locking in an aforementioned first direction.

The coupling parts preferably are configured such that in the coupled condition of two such floor panels, the downward-directed locking element is clamped between a vertical closing surface, which is formed between the two floor panels and the proximal side of the upward-directed locking element. Such clamping offers the advantage that possible gap formation, for example, as a consequence of the setting up of the floor panels under the influence of temperature, can be counteracted. By such clamping, the floor panels also can be coupled in a smooth manner, in view of the fact that the clamping can provide for that a clicking effect is clearly perceptible during coupling of the floor panels.

The thickness of the floor panel preferably is smaller than 6 mm. Still more preferably, this thickness is smaller than 5 mm, and most preferably the thickness is smaller than 4 mm. Such thickness offers the advantage that the floor panels can be made sufficiently strong, but still are sufficiently thin, which can result in material economization. Moreover, the coupling parts of the invention are particularly suitable for being applied in floor panels with such thickness.

In the coupled condition of two such floor panels, the aforementioned locking surfaces, seen in cross-section, may be situated entirely in the lower half of the floor panel. Due to this characteristic, the locking surfaces can be made rather compact, however, still sufficiently strong. This characteristic also allows to make the floor panels relatively thin, preferably with a thickness as described herein above.

The aforementioned angle preferably is smaller than 60 degrees. Still more preferably, the angle is smaller than 45 degrees. Most preferably, the angle is smaller than 30 degrees. Hereby, a particularly strong vertical locking can be provided while still guaranteeing the installation ease of the floor panels.

Preferably, the lip of the lower hook-shaped part comprises an incision on an underside of this lip, which incision extends in horizontal direction starting from a distal side of the upward-directed locking element and at least up to said locking surfaces. Such incision contributes to the installation ease of the floor panels. In fact, it provides for that the lip of the lower hook-shaped part can bend during coupling of the floor panels, such that sufficient space can be created for the mutual engagement of the hook-shaped parts. In particular, the incision extends in horizontal direction to beyond said locking surfaces.

In the coupled condition of two such floor panels, an interspace is provided in the entire intermediary space between a distal side of the upward-directed locking element of the one floor panel and the edge of the other floor panel. Such interspace contributes to the installation ease of the floor panels. In particular in combination with the herein above-mentioned incision, the interspace offers the possibility of creating sufficient space for the herein above-mentioned bending of the lip of the lower hook-shaped part during coupling of the floor panels. In particular, the interspace extends up to below the lip of the upper hook-shaped part.

Preferably, an interspace is present between a vertical closing surface, which is formed between two such floor panels in the coupled condition and a support surface, which belongs to the lip of the lower hook-shaped part and serves for supporting the downward-directed locking element. Such interspace contributes to the smooth installation of the floor panels. In fact, the interspace allows that sufficient space is created for pressing down the downward-directed locking element in order to achieve the coupled condition. In particular, the lip of the lower hook-shaped part also comprises a floating support surface for the downward-directed locking element, wherein preferably an interspace is present between the floating support surface and the downward-directed locking element. Such floating support surface offers the advantage that a boundary is set for the possibility of pressing down the downward-directed locking element. This offers the possibility of minimizing possibly obtained height differences, for example, when walking on the installed floor panels. To this aim, said interspace has a thickness of maximum 2 mm and still more preferably has a thickness of maximum 1 mm. However, still more preferably, the interspace between the floating support surface and the downward-directed locking element has a thickness of maximum 0.2 mm and most preferably of maximum 0.1 mm. The interspace between the floating support surface and the downward-directed locking element also allows to accommodate tolerances which occur, for example, by means of milling treatments, during manufacturing of the coupling parts.

Preferably, said support surface is situated more closely to the upward-directed locking element than said floating support surface. Preferably, the support surface is situated lower than said floating support surface. Preferably, the interspace between the vertical closing surface and the support surface extends continuously from the vertical closing surface to said support surface. Such measures all contribute to the installation ease of the floor panels.

The downward-directed locking element preferably comprises a protrusion, which is clamped between the second locking surface and said support surface. Hereby, a particularly strong vertical locking can be provided and it can be prevented that the protrusion will come out of the locked condition, for example, under the influence of external forces.

The lip of the lower hook-shaped part preferably shows a minimum thickness which is larger than ¼ of the overall thickness of the floor panel. Hereby, the lip of the lower hook-shaped part can be made stable. With the same aim, the lip of the lower hook-shaped part can show a minimum thickness which is larger than ⅓, and preferably is larger than 5/12, of the maximum thickness of the upward-directed locking element.

The lip of the lower hook-shaped part can show a varying thickness. This offers the possibility of providing the lip, on the one hand, with sufficient stability and providing the lip, on the other hand, with other features, such as flexibility. To this aim, the lip can be made relatively thick there, where stability is desired, whereas the lip can be made relatively thin there, where flexibility is desired. In particularly, the lip of the lower hook-shaped part becomes thicker in a direction away from the upward-directed locking element. Hereby, the lip can be connected to the core of the floor panel in a stable manner and can be provided with the necessary flexibility next to the upward-directed locking element. Such flexibility allows possibly bending the lip during coupling of the floor panels, such that this coupling may be performed in a smooth manner.

The lip of the lower hook-shaped part preferably has a minimum thickness which is larger than ⅓ of the overall thickness of the floor panel. Hereby, the lip of the upper hook-shaped part can be made stable. With the same aim, the lip of the upper hook-shaped part can show a minimum thickness which is larger than ½ of the maximum thickness of the downward-directed locking element.

The lip of the upper hook-shaped part can show a varying thickness. This offers the possibility of providing the lip with sufficient stability, on the one hand, and providing the lip with other features, such as flexibility, on the other hand. To this aim, the lip can be made relatively thick there, where stability is desired, whereas the lip can be made relatively thin there, where flexibility is desired. In particular, the lip of the upper hook-shaped part becomes thicker in a direction away from the downward-directed locking element. Hereby, the lip can be connected to the core of the floor panel in a stable manner and can be provided with the necessary flexibility next to the downward-directed locking element. Such flexibility allows possibly bending the lip during coupling of the floor panels, such that this coupling may be performed in a smooth manner Preferably, the coupling parts substantially are made massive. This means that, although weakened portions and/or recesses may be provided in the coupling parts, these are restricted such that they do not substantially determine the deformation of the coupling parts during coupling. Most preferably, the coupling parts are made massive and the coupling parts thus are free from weakened parts and/or recesses which allow deformations of the coupling parts.

Preferably, the floor panel is oblong, wherein the aforementioned pair of opposite edges is situated on the short sides of the floor panel and wherein the pair of opposite edges on the long sides of the floor panel also comprises coupling parts which allow a locking in a first direction perpendicular to the plane of the floor panel, as well as in a second direction perpendicular to said edges on the long sides and in the plane of the floor panel.

The coupling parts on the opposite pair of edges on the long sides of the floor panel preferably are configured such that two such floor panels can be coupled at these edges by means of a turning movement of one floor panel in respect to the other floor panel, in such a manner that a plurality of such floor panels can be coupled by means of the so-called "fold-down" technique.

The coupling parts on the opposite pair of edges on the long sides can be configured such that two such floor panels can be coupled at these edges by means of a horizontal snap movement of one floor panel in respect to the other floor panel.

It is also noted that the herein above-mentioned preferred and alternative features of the invention can be combined at choice with each of the independent aspects, as far as these do not create any contradictions, or as far as they are not already mentioned as a feature in the respective aspect.

The invention relates to a method for manufacturing a floor panel for forming a floor covering, wherein this floor panel comprises a substrate, which substrate is manufactured on the basis of synthetic material and comprises filling means; wherein this floor panel, on at least one pair of opposite edges, comprises coupling parts; and wherein these coupling parts allow a locking in a first direction perpendicular to the plane of the floor panel, as well as in a second direction perpendicular to the edges and in the plane of the floor panel; with the characteristic that at least a portion of said coupling parts is manufactured from the material of said substrate by means of planing and/or scraping treatments, preferably broach and/or broaching treatments. Such planing and/or scraping treatments offer the advantage that the coupling parts can be made very precisely. In particular, they can be advantageously employed for precise manufacturing of finer portions of the coupling parts, such as an undercut or the like. Moreover, the inventor rather unexpectedly has found that such treatments can be successfully applied in substrates which comprise fillers.

The filling means can consist of plasticizers and/or fillers, such as chalk and/or limestone. Such filling means allow giving new features to the synthetic substrate, for example, in the field of strength or flexibility. At the same time, fillers such as chalk and/or limestone offer economic advantages. According to an alternative, whether or not combined with the herein above-mentioned filling means, the filling means may consist of wood fibers.

The invention also relates to a method for manufacturing a floor panel for forming a floor covering, wherein this floor panel comprises a substrate, which substrate is manufactured on the basis of synthetic material; wherein this floor panel, on at least one pair of opposite edges, comprises coupling parts, which coupling parts allow that two such floor panels can be coupled to each other by means of a downward movement of one floor panel in respect to the other floor panel; wherein these coupling parts allow a locking in a first direction perpendicular to the plane of the floor panel, as well as in a second direction perpendicular to the edges and in the plane of the floor panel; with the characteristic that least a portion of said coupling parts is manufactured from the material of said substrate by means of planing and/or scraping treatments, preferably broach and/or broaching treatments. In that such planing and/or scraping treatments are employed, the advantage is created that the coupling parts can be manufactured in a precise manner.

Preferably, the method also shows the characteristic that said coupling parts consist of a downward-directed upper hook-shaped part, which is situated on the one edge of said pair of opposite edges, as well as of an upward-directed lower hook-shaped part, which is situated on the other, opposite edge of said pair of opposite edges, which hook-shaped parts can be engaged behind each other by means of said downward movement; that the upper hook-shaped part consists of a lip which is provided with a downward-directed locking element, whereas the lower hook-shaped part consists of a lip which is provided with an upward-directed locking element; that the locking elements are provided with locking surfaces which at least partially allow the locking in said first direction perpendicular to the plane of the floor panels; and that at least said locking surfaces are manufactured from the material of said substrate by means of planing and/or scraping treatments, preferably broach and/or broaching treatments. The inventor has found that such planing treatments are particularly advantageous when manufacturing the mentioned locking surfaces, which at least partially provide for the vertical locking.

In particular, the locking surfaces comprise a first and second locking surface, which first locking surface belongs to a proximal side of the downward-directed locking element, and which second locking surface belongs to a proximal side of the upward-directed locking element.

Still more particularly, said locking surfaces, in the coupled condition of two such floor panels, define a tangent line forming an angle with the plane of the floor panel, which angle is smaller than 90 degrees, and/or said second locking surface defines such angle. Such locking surfaces may define an undercut, which is difficult to manufacture by means of traditional milling treatments. However, the inventor has found that such undercuts in fact can be manufactured easily and precisely by means of the mentioned planing treatments.

The remainder of the coupling parts can be manufactured substantially from the material of said substrate substantially by means of milling treatments.

The methods, such as described herein above, can be applied for manufacturing a floor panel according to the herein above-described aspects of the invention, as well as for manufacturing a floor panel according to their preferred and alternative embodiments.

BRIEF DESCRIPTION OF THE DRAWINGS

With the intention of better showing the characteristics of the invention, herein below, as an example without any limitative character, some preferred embodiments are described, with reference to the accompanying drawings, wherein.

DETAILED DESCRIPTION OF PREFERRED EMBODIMENTS OF THE INVENTION

Figure 1:
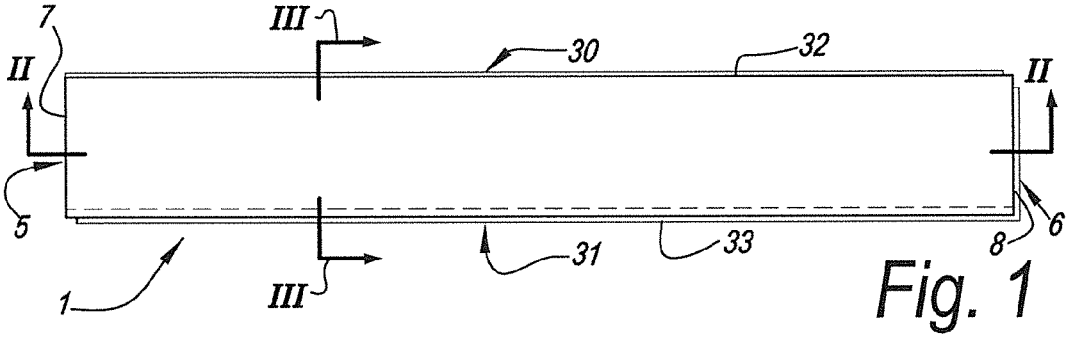
FIG. 1 represents a floor panel according to the invention.

FIG. 1 represents a floor panel 1 according to the invention, which can be applied for forming a floor covering. The floor panel 1 is oblong and comprises a pair of opposite edges 5-6 on the short sides of the floor panel 1 and a pair of opposite edges 30-31 on the long sides of the floor panel 1. The pair of opposite edges 5-6 comprises coupling parts 7-8, whereas the pair of opposite edges 30-31 comprises coupling parts 32-33.

Figure 2:
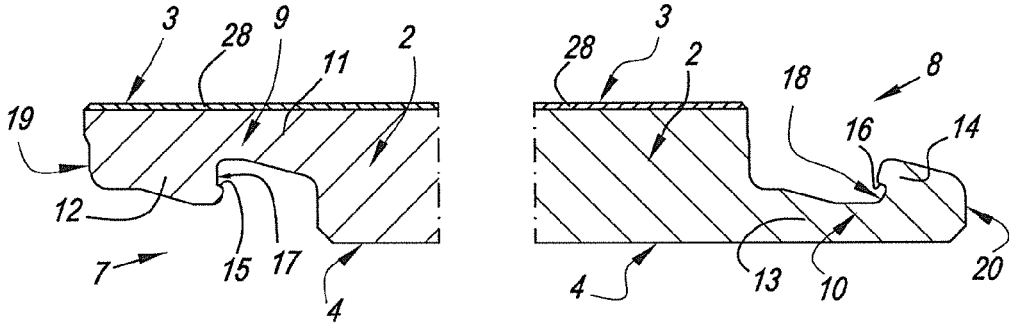
FIGS. 2 and 3, at a larger scale, represent a cross-section according to the lines II-II and III-III, respectively, shown in FIG. 1.

FIG. 2 represents a cross-section according to line II-II in FIG. 1. The floor panel 1 comprises a substrate 2, which preferably is manufactured on the basis of synthetic or thermoplastic material, such as polyvinyl chloride. The floor panel 1 comprises a top layer 28, which comprises at least a decor and a transparent or translucent wear layer situated on the decor.

The coupling parts 7-8 are entirely formed from the material of the substrate 2 and are made in one piece therewith. Moreover, substantially they are made massive.

The coupling parts 7-8 consist of a downward-directed upper hook-shaped part 9, which is situated on the one edge 5 of said pair of opposite edges 5-6, as well as an upward-directed lower hook-shaped part 10, which is situated on the other, opposite edge 6 of the aforementioned pair of opposite edges 5-6.

The upper hook-shaped part 9 consists of a lip 11 which is provided with a downward-directed locking element 12, whereas the lower hook-shaped part 10 consists of a lip 13 which is provided with an upward-directed locking element 14.

The locking elements 12 and 14 are provided with locking surfaces 15-16, which at least partially, and here entirely, allow the locking in said first direction V perpendicular to the plane of the floor panels 1. The locking surfaces 15-16 comprise a first locking surface 15 and a second locking surface 16. The first locking surface 15 belongs to a proximal side 17 of the downward-directed locking element 12, and the second locking surface 16 belongs to a proximal side 18 of the upward-directed locking element 14. That the locking surfaces 15-16 belong to the mentioned proximal sides 17-18, offers the advantage that the floor panels 1 can be coupled in a smooth manner.

On a distal side 19 of the downward-directed locking element 12, the floor panel 1 is free from locking parts, which partially or entirely allow a locking in an aforementioned first direction V. Also, the floor panel 1, on a distal side 19 of the upward-directed locking element, is free from locking parts which, partially or entirely, allow a locking in an aforementioned first direction V. The absence of such locking parts on the mentioned distal sides 19-20 contributes to the possibility of smoothly coupling the floor panels 1.

Figure 3:
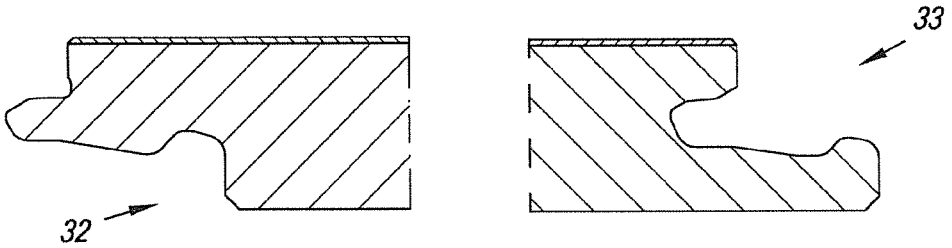
Figure 4:
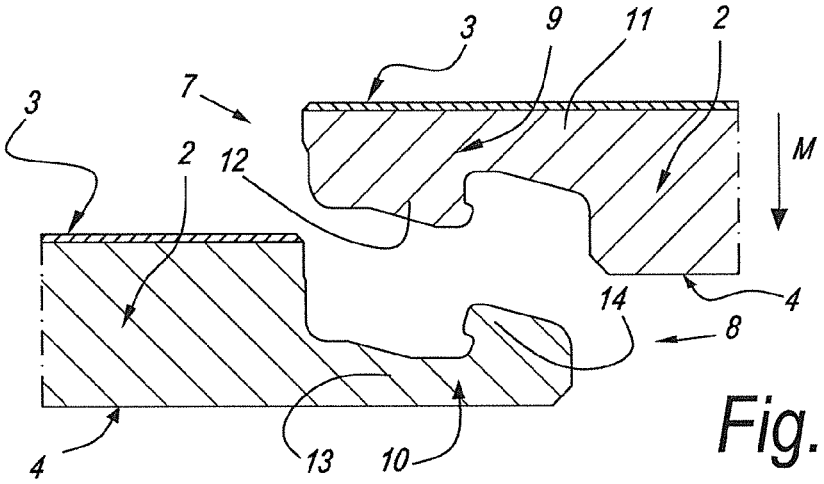
FIGS. 4 to 7 represent how two floor panels can be coupled to each other at the edges from FIG. 2.

FIG. 3 represents a cross-sectional view according to line in FIG. 1. The coupling parts 32-33 are realized in the form of a tongue and a groove, respectively.

FIGS. 4 to 7 represent how two floor panels 1 can be coupled to each other at the edges 5-6. The coupling parts 7-8 allow that two such floor panels 1 can be coupled to each other by means of a downward movement M of one floor panel 1 in respect to the other floor panel 1.

Figure 5:
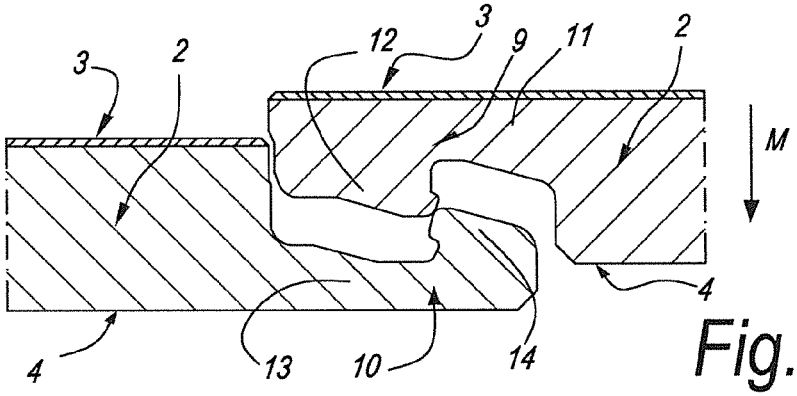

FIG. 5 represents that the coupling parts 7-8 do not just like that drop into each other during the downward movement M. As a result of the presence of the locking surfaces 15-19, a resistance has to be overcome, such that the hook-shaped parts 9-10 will engage in each other. The elasticity of the synthetic material of the substrate 2 helps to overcome this resistance in view of the fact that it allows deformations of the coupling parts 7-8. Thus, it provides, together with the specific configuration of the coupling parts 7-8, for a smooth coupling of the coupling parts 1 at the edges 5-6.

Hereby, it is also noted that a resistance as mentioned herein above, which is the consequence of the presence of the locking surfaces 15-16 on the proximal sides 17-18, can be overcome more simply than a possible resistance which is created by locking parts present on the distal sides 19-20. Such last-mentioned resistance, to wit, less easily allows an elastic deformation of the coupling parts, such as, for example, a downward bending of the lip of the lower hook-shaped part.

Figure 6:
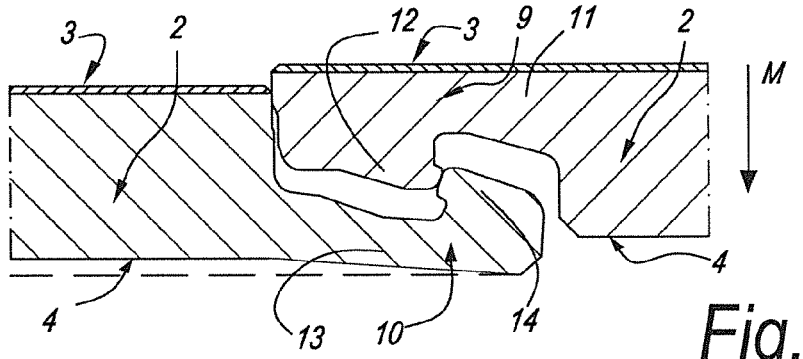

FIG. 6 represents an example of a deformation of the coupling parts 7-8, wherein the lip 13 of the lower hook-shaped part 10 is bent downward when performing the downward movement M, such as represented by the dotted line. Such elastic bending of the lip 13 increases the available space for the locking element 12, such that this locking element 12 simply can be pressed down.

In an analogous way, it is possible that the lip 11 of the upper hook-shaped part 9 is bent upward when performing the downward movement M. Such upward bending of the lip 11, however, is not represented here.

Another example of a possible deformation, which is not represented here, relates to an elastic compression of the locking element 12 and/or the locking element 14, more particularly an elastic compression of the portion of the locking element 12 to which the locking surface 15 belongs and/or the portion of the locking element 14 to which the locking surface 16 belongs.

It is also noted that two or more of the herein above-described deformations may occur together when performing the coupling movement between the floor panels 1.

Figure 7:
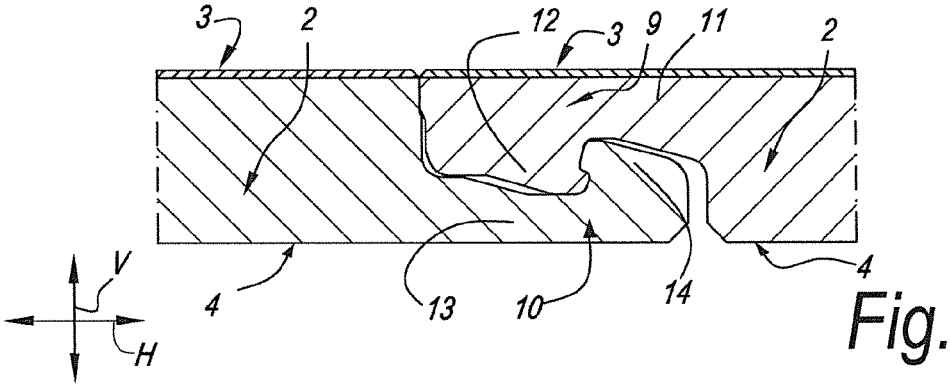

FIG. 7 represents the floor panels 1 in coupled condition. In this coupled condition, the coupling parts 7-8 allow a locking in a first direction V perpendicular to the plane of the floor panels 1, as well as in a second direction H perpendicular to the edges 5-6 and in the plane of the floor panels 1.

Figure 8:
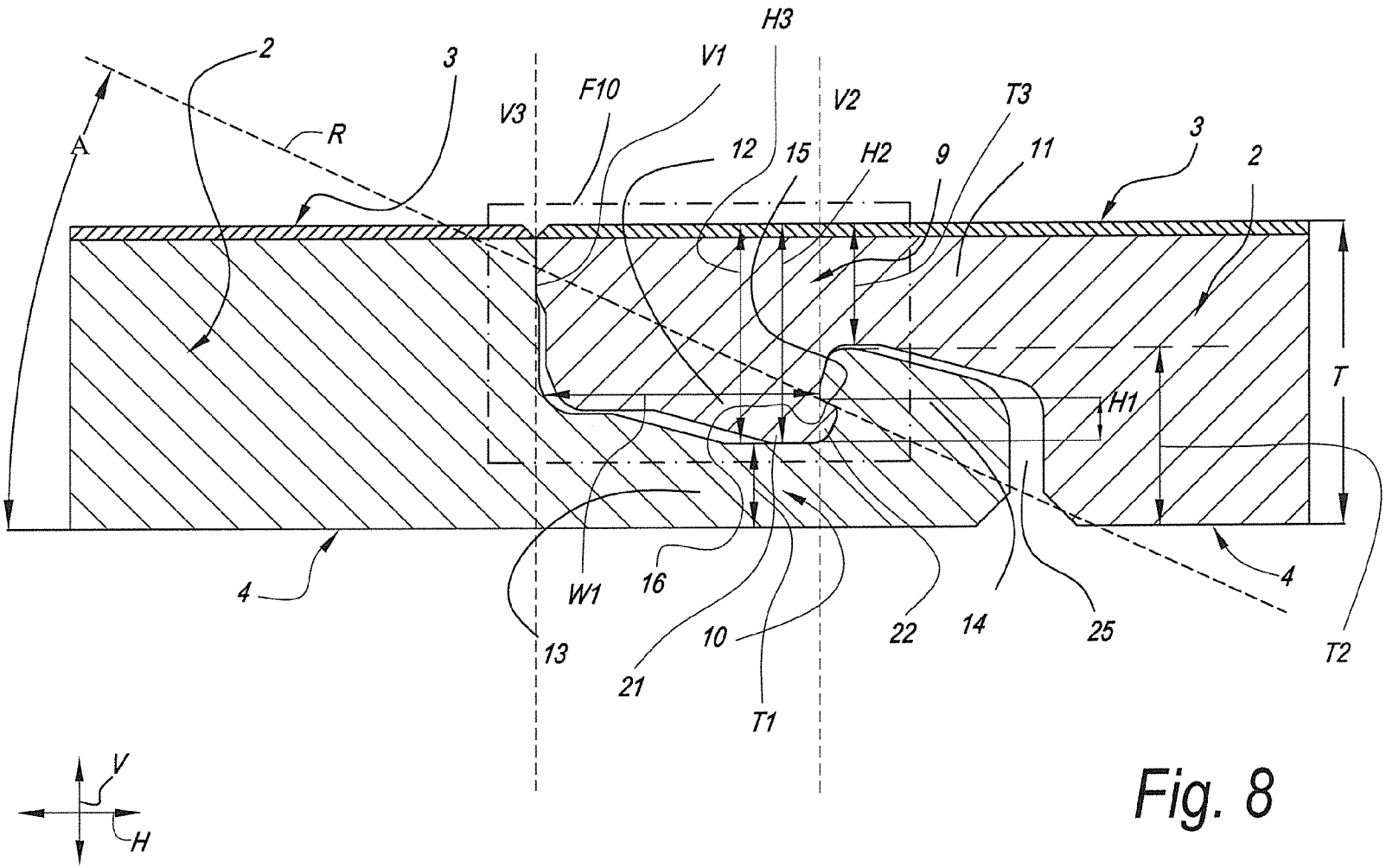
FIG. 8 for clearness' sake represents the coupling parts from FIG. 2 in completely coupled condition.

FIG. 8, at a larger scale, represents the coupled condition from FIG. 7.

The floor panel 1 shows a thickness T which is smaller than 6 mm and preferably is smaller than 5 mm, and still more preferably is smaller than 4 mm.

In the coupled condition of two such floor panels 1, the locking surfaces 15-16 define a tangent line R forming an angle A with the plane of the floor panel 1. The angle A is smaller than 30 degrees and larger than 0 degrees. More particularly, the angle A is equal to 25 degrees. Such rather minor angle offers the advantage that a very strong vertical locking is allowed, by which the risk of height differences or gap formation between the coupled floor panels can be minimized.

The inventor has found that for realizing such locking surfaces 15-16, planing and/or scraping treatments, or breach and/or breaching treatments, can be applied in an advantageous matter. Such treatments allow to manufacture the locking surfaces 15-16 precisely as well as efficient. The remaining portions of the coupling part 7-8 can be realized by means of milling treatments.

The tangent line R is directed upward in the direction of the vertical V3 through the vertical closing surface V1 formed between the coupled floor panels 1. More particularly, the tangent line R intersects the vertical V3 in such a manner that the intersection point is situated underneath the upper side 3 of the floor panels 1. That the mentioned intersection point is situated underneath the upper side 3 of the floor panels, is also caused by the relatively small angle A, as well as by the relatively low position of the locking surfaces 15-16 in the floor panel. It offers as an advantage that a particularly strong vertical locking can be effected between the floor panels, whereas the floor panels still can be installed in a smooth manner.

The locking surfaces 15-16 extend continuously over the major part of the length of the edges 5-6. Hereby, a strong vertical locking can be effected over the major part of the edges.

In the coupled condition of the floor panels 1, the locking surfaces 15-16, seen in cross-section, are situated entirely in the lower half of the floor panel 1. So, the locking surfaces 15-16 can be realized relatively compact, such that a smooth installation of the floor panels 1 remains possible. The resistance, as described herein above, then is sufficiently small. Such relatively low position of the locking surfaces 15-16 also offers as an advantage that the lip 13 can be made relatively thin at the position of the locking surfaces 15-16, and that the lip 13 as such can undergo elastic deformations relatively easy.

The downward-directed locking element 12 comprises a protrusion 21, of which, in the coupled condition of the floor panels 1, at least a portion 22 is situated past beyond the vertical tangent line V2. The vertical tangent line V2 touches the upward-directed locking element 14 in a most proximally situated point of this upward-directed locking element 14. The maximum height H1 of the part 22 is at least ⅕ of the maximum thickness H2 of the downward-directed locking element 12 and maximum ¼ of this maximum thickness H2. That the part 22 shows such height H1, offers the advantage that the portion can be realized relatively compact, which is beneficial for the smoothness of installation, however, can also be provided with sufficient strength in order to provide a strong vertical locking. In that the part 22 has the height H1, this part 22 also is extremely suitable for being applied in relatively thin floor panels 1.

The horizontal distance W1 between said most proximally situated point of the upward-directed locking element 14 and the edge 6 of the floor panel 1 is larger than the vertical distance H3 between the upper side 3 of the floor panel 1 and the most downward-situated point of the lip 13 of the lower hook-shaped part 10. That the opening for the locking element 12 is realized this wide, offers the advantage that the locking element 12 can be made very stable, such that the risk of breaking, for example, during coupling of the floor panels 1, can be minimized.

In the coupled condition of the floor panels 1, an interspace 25 is provided in the entire intermediary space between the distal side 20 of the upward-directed locking element 14 of the one floor panel 1 and the edge 5 of the other floor panel 1. The interspace 25 extends up to below the lip 11 of the upper hook-shaped part 9. Such interspace 25 contributes to the installation ease of the floor panels 1, in view of the fact that the interspace 25, for example, creates space for a possible bending of the lip 13 during the coupling movement.

The lip 13 of the lower hook-shaped part 10 shows a minimum thickness T1, which is larger than ¼ of the overall thickness T of the floor panel 1. This offers the advantage that the lip 13 can be realized sufficiently strong and stable, such that the lip 13 does not break off, for example, during the herein above-described bending. For this same purpose, the minimum thickness T1 of the lip 13 is larger than ⅓ and preferably larger than 5/12 of the maximum thickness T2 of the locking element 14.

Moreover, the lip 13 has a varying thickness. In this manner, the lip 13 can be provided with sufficient strength and stability, on the one hand, and obtain sufficient flexible features, on the other hand. More particularly, the lip 13 becomes thicker in a direction away from the upward-directed locking element 14. In this manner, a strong connection with the core of the floor panel 1 can be guaranteed.

With the purpose of providing the lip 11 with sufficient strength and stability, this lip 11 shows a minimum thickness T3 which is larger than ⅓ of the overall thickness T of the floor panel. More particularly, the minimum thickness T3 is larger than ½ of the maximum thickness H2 of the downward-directed locking element.

The lip 11 of the upper hook-shaped part 9 has a varying thickness. In this manner, the lip 11 can be provided with sufficient strength and stability, on the one hand, and obtain sufficient flexible features, on the other hand. More particularly, the lip 11 becomes thicker in a direction away from the downward-directed locking element 12. In this manner, a strong connection with the core of the floor panel 1 can be guaranteed.

Figure 9:
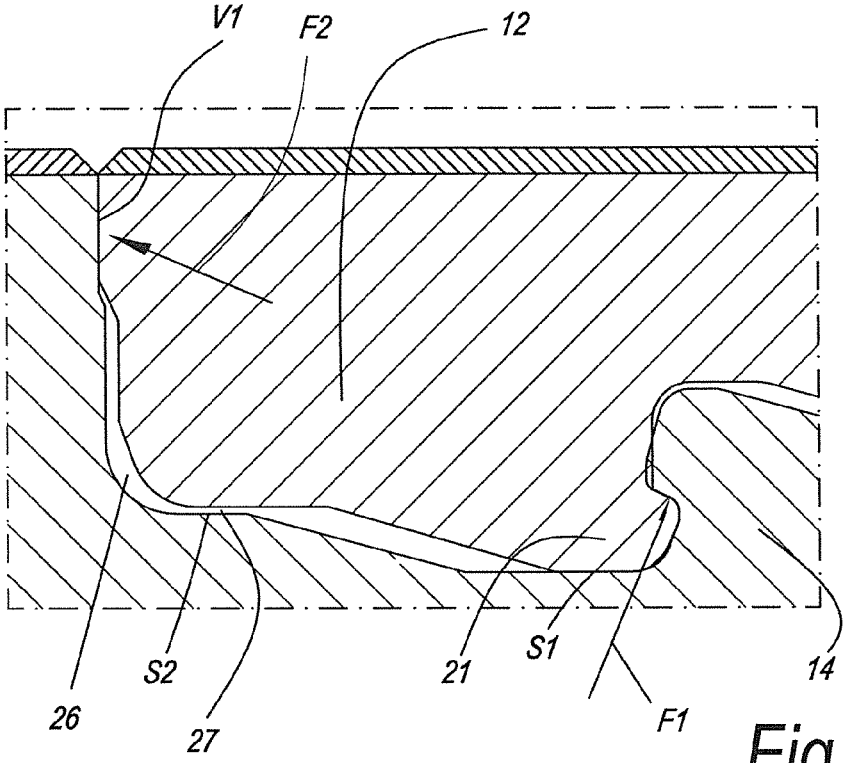
FIG. 9, at a larger scale, represents a view of the part indicated by F10 in FIG. 8.

FIG. 9, at a larger scale, represents the part indicated by F10 in FIG. 8. The contours of the coupling parts 7-8, which are represented here, correspond to the contours of the coupling parts in the uncoupled condition of the floor panels 1. As represented, the coupling parts 7-8 are configured such that their contours overlap. Due to the overlapping contours, in the coupled condition one or more tensioning forces are created, which have a positive influence on the locking between the floor panels 1. Such tensioning forces allow minimizing the risk of gap formation and height differences in the installed condition of the floor panels 1.

FIG. 9 represents a first tensioning force F1, which is present at the location of the locking surfaces 15-16. This tensioning force F1 provides for that the locking surfaces 15-16 are pressed towards each other and thus can effect a particularly strong locking. Moreover, a second tensioning force F2 is present at the location of the vertical closing surface V1. Hereby, the edges 5-6 present at the closing surface V1 are pressed towards each other, such that gap formation can be counteracted in the installed condition of the floor panels.

FIG. 9 also shows that as a result of the overlapping contours, the locking element 12 is clamped between the closing surface V1 and the proximal side 18 of the locking element 18. Herein, also the protrusion 21 is sitting clamped between the locking surface 16 and the support surface S1.

FIG. 9 represents that the lip 13 comprises a support surface S1 for supporting the locking element 12. Between this support surface S1 and the vertical closing surface V1, an interspace 26 is present. This interspace 26 helps with the smooth coupling of the floor panels 1.

The lip 13 also comprises a floating support surface S2, wherein an interspace 27 is present between this support surface S2 and the locking element 12. The interspace 27 has a thickness of maximum 2 mm and preferably of maximum 1 mm. Such interspace 2 provides for the necessary space for pressing down the downward-directed locking element 12. Also, the floating support surface S2 provides for the at least partial taking up of tolerances which occur during the manufacture of the coupling parts 7-8.

The support surface S1 is situated closer to the locking element 14 than the floating support surface S2 and is situated lower than the support surface S2.

The herein above-mentioned interspace 26 extends continuously from said vertical closing surface (V2) up to said support surface (S1).

Figure 10:
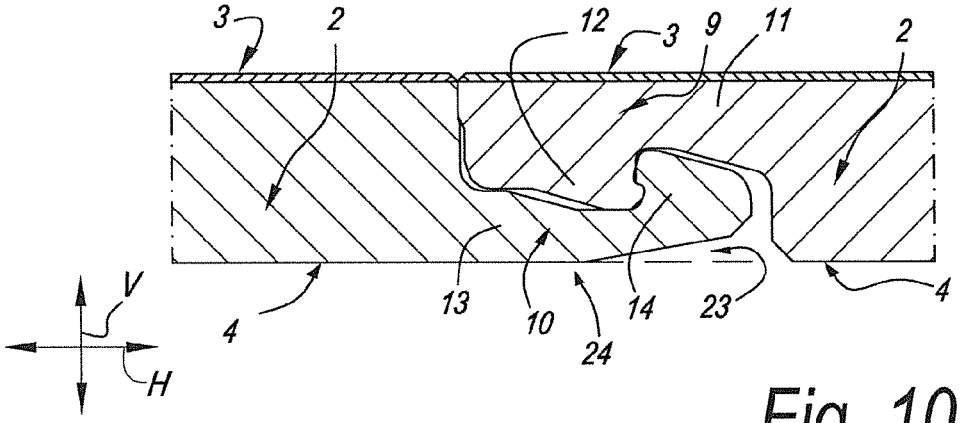
FIGS. 10 to 14 represent variants of the invention.
Figure 11:
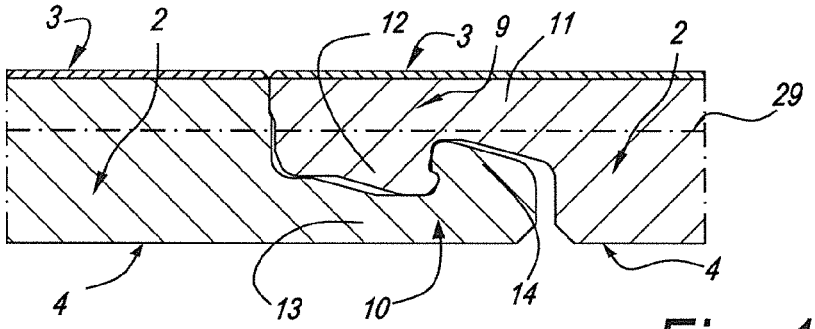
Figure 12:
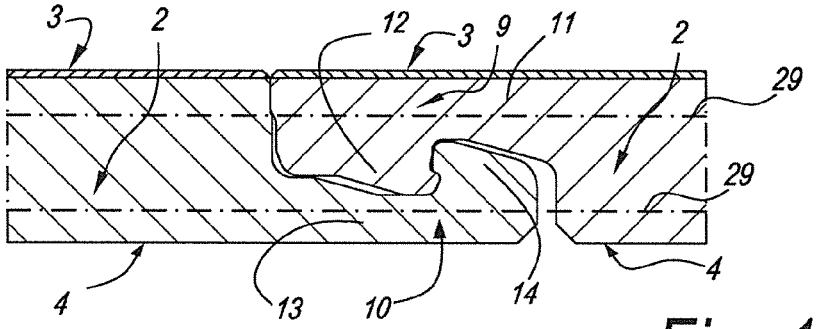
Figure 13:
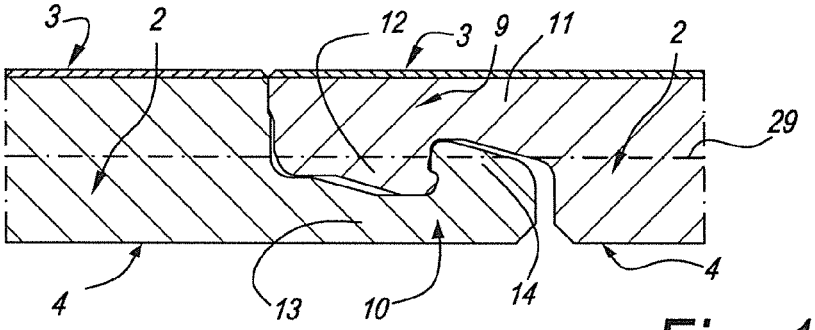
Figure 14:
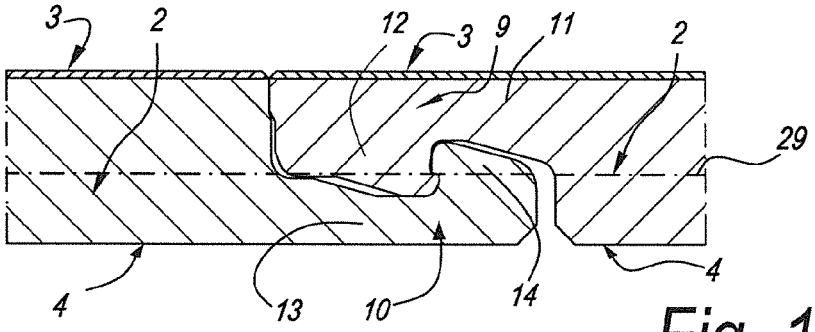

FIG. 10 represents another variant of the invention, wherein the lip 13 comprises an incision 23 on the lower side 24 of the lip 13. The incision 23 extends in horizontal direction from the distal side 20 of the upward-directed locking element 14 and at least up to said locking surfaces 15-16. Such incision facilitates the possible downward bending of the lip 13 during the coupling movement. Here, the incision 23 extends to beyond the locking surfaces 15-16.

FIGS. 11 to 14 represent more variants of the invention, wherein the floor panel 1 is provided with one or more reinforcement layers 29.

Figure 15:
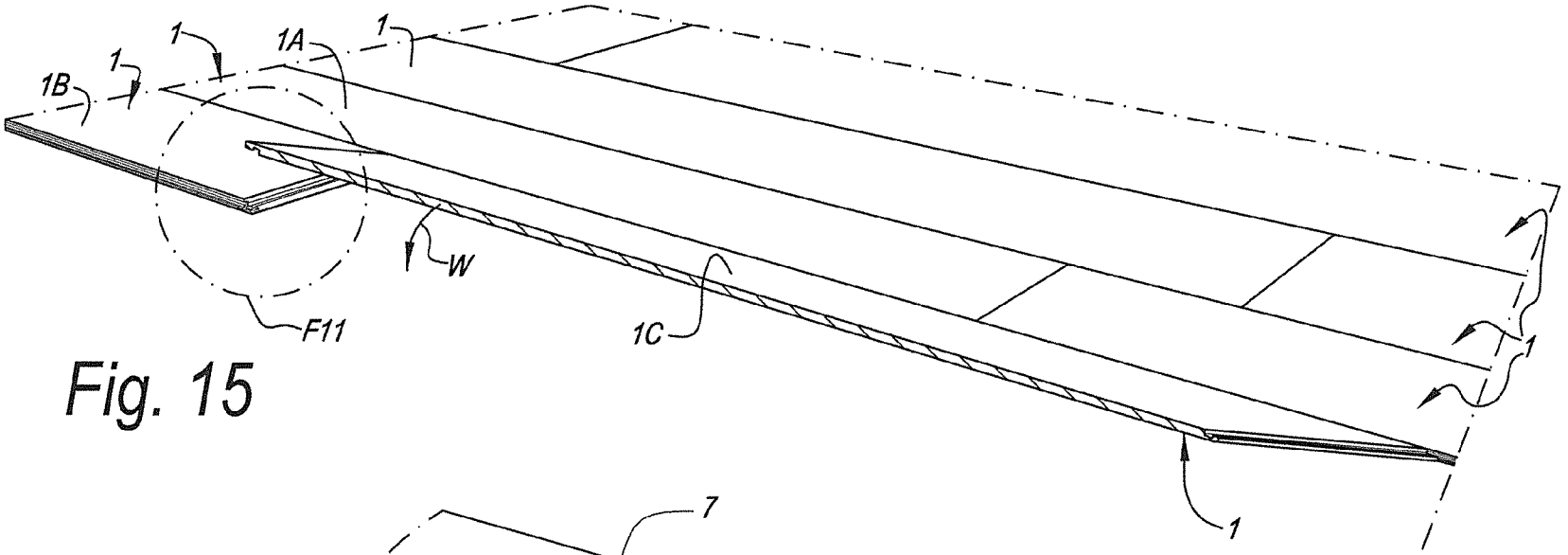
FIGS. 15 and 16 represent in perspective how the long and short edges of the floor panel from FIG. 1 can be coupled to similar floor panels, wherein FIG. 16 at a larger scale provides a view on the area indicated by F11 in FIG. 15.

FIG. 15 represents how the floor panels 1 can be coupled to each other by means of the so-called fold-down technique. Herein, the floor panel 1C to be coupled is coupled at one of its long sides to the floor panels 1A of a preceding row, whereas the floor panel 1A simultaneously, i.e. with the same turning movement W, is coupled on one of its short sides to a floor panel 1B from the same row. To this aim, the long sides of the floor panels 1 are provided with coupling parts 32-33, which allow the coupling by means of the turning movement W, and the short sides are provided with coupling parts 7-8, which allow a coupling by means of a downward movement as a result of the turning movement W. The herein above-described coupling parts 7-8 can be applied particularly advantageous in such so-called fold-down floor panels 1. In fact, they provide for a smooth installation, as well as for a strong locking in the coupled condition.

Figure 16:
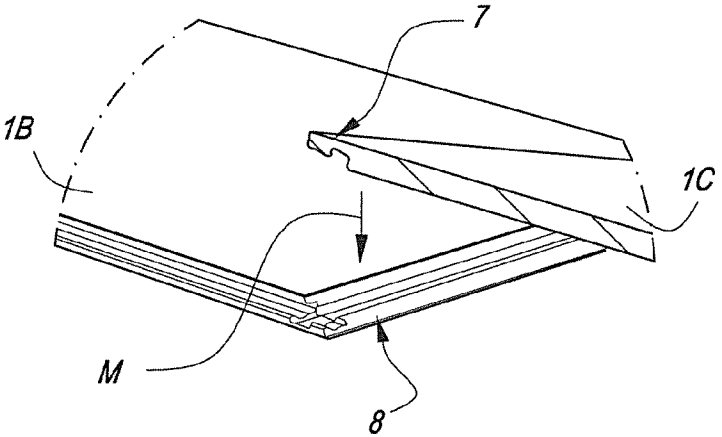

FIG. 16 represents in an enlarged manner what is indicated by F11 in FIG. 15.

Figure 17:
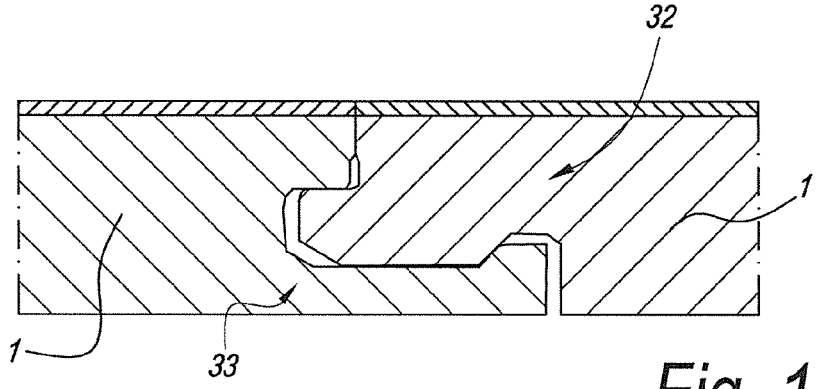
FIG. 17 represents a variant of the embodiment in FIG. 3.

FIG. 17 represents coupling parts 32-33, which allow that the floor panels can be coupled by means of a turning movement W and which can be applied in the herein above-mentioned fold-down movement. The coupling parts 32-33 allow a locking in a first direction V perpendicular to the plane of the floor panel 1, as well as in a second direction H perpendicular to the aforementioned edges 30-31 and in the plane of the floor panel 1.

Figure 18:
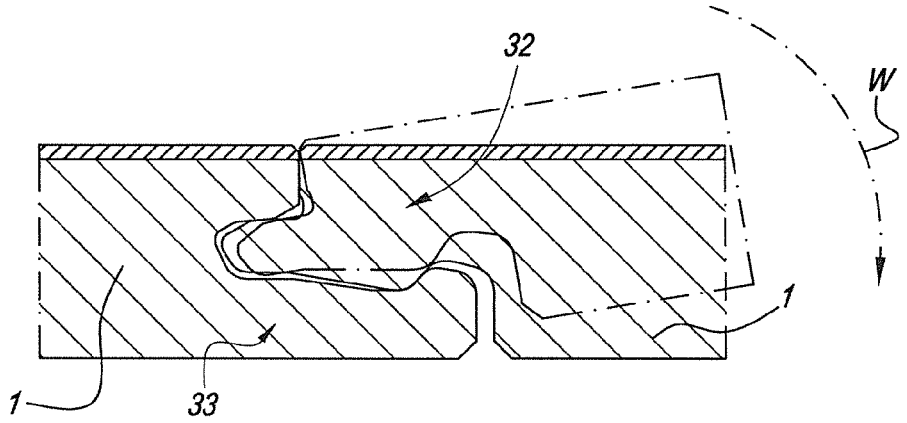
FIGS. 18 and 19 represent how two floor panels can be coupled to each other at the edges from FIG. 3.

FIG. 18 represents an alternative of the coupling parts 32-33 of FIG. 17, which allow that the floor panels can be coupled by means of a turning movement, and can be applied with the herein above-described fold-down technique.

Figure 19:
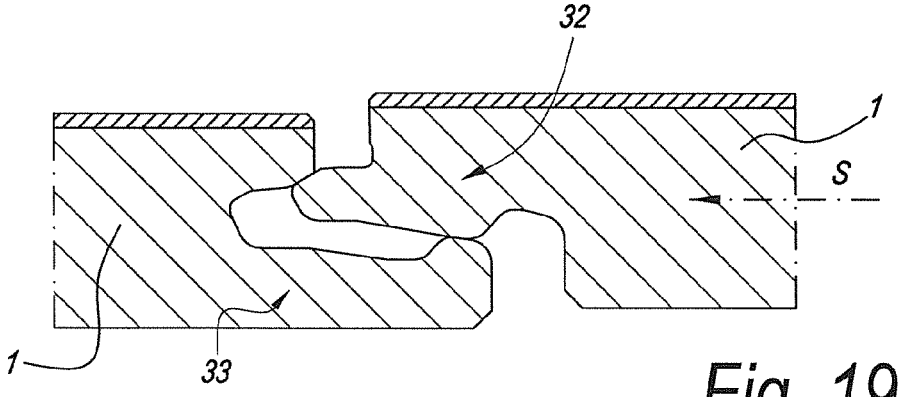

Moreover, the coupling parts 32-33 of FIG. 18 are configured such that they also allow a horizontal snap movement S of one floor panel 1 in respect to the other floor panel 1 in order to couple the floor panels 1. Such horizontal snap movement S is represented in FIG. 19.

It is clear that in FIG. 9 the shape of the coupling parts is represented such as it is in the free condition of these coupling parts. The coupling parts show an overlapping shape, such that the floor panels in coupled condition are seated in each other with a so-called "pretension".

It is clear that this primarily relates to decorative floor panels, thus, with a decorative upper side, for forming a floor covering on an existing supporting floor, and more particularly for forming a floating floor covering.

In particular, the invention is intended for floor panels which substantially consist of synthetic material, and still more for floor panels of the supple type. More particularly, the invention shows its advantages best with vinyl floor panels, in particular so-called vinyl tiles, and in particular with floor panels of the so-called LVT type ("Luxury Vinyl Tile") or VCT type ("Vinyl Composite Tile", also called "Vinyl Composition Tile").

Such synthetic material floor panel, and in particular supple synthetic material floor panel, and more particularly such vinyl tile, preferably shows any of the following characteristics:

the floor panel is substantially composed of a substrate of one or more basic layers and at least a top layer, wherein the top layer as such may or may not be composed of a plurality of layers;

herein, the top layer comprises at least a decorative layer, preferably in the form of a print, preferably provided on a foil or film;

the top layer comprises at least a translucent or transparent wear layer;

the floor panel substantially is composed of a thermoplastic material, preferably a soft thermoplastic material;

the floor panel, or at least the substrate, substantially is composed of polyvinyl chloride, more particularly of soft polyvinyl chloride, more particularly provided with plasticizers or the like; a composition "substantially" on the basis of PVC must be interpreted broadly in view of the fact that a large number of additives, for example, fillers, can be used in PVC floors;

the floor panel comprises at least one reinforcement layer, preferably formed of fibers, more particularly reinforcement fibers, such as glass fibers;

preferably, the reinforcement layer is situated halfway the thickness of the floor panel; preferably, the reinforcement layer is not interrupted across the floor panel, which results in an increased stability of the floor panel in comparison with an interrupted reinforcement layer; preferably, the reinforcement layer is situated at the height of the protrusion (21) and/or at the height of the locking surfaces (15-16), with the advantage that the strength of this protrusion and/or these locking surfaces, and consequently the strength of the vertical locking between the floor panels, is increased.

It is noted that "soft PVC" is a term expressing that this relates to supple PVC, in other words, PVC which is relatively readily bendable. The term soft PVC is generally known in the technique. Such soft PVC consists of PVC which is softened, preferably by means of a plasticizer added during the production process. Depending on the added amount of plasticizer, of course various degrees of suppleness can be obtained.

By a plasticizer, any material is to be understood which, by being added, results in a more supple PVC. Typical examples are phthalate plasticizers and isosorbide plasticizers.

By PVC which has been softened, of course also PVC can be understood, or a composition on the basis of PVC can be understood, which, for example, as it has been modified, as such has the feature of being supple.

The same is also valid for other "soft synthetic materials", and the above is not restricted to PVC.

As already mentioned herein above, the present invention shows its advantages beset when it is applied with floor panels which substantially are manufactured of supple or soft synthetic material, or in other words with supple floor panels.

By supple floor panels, floor panels are meant which, when they, in the case of a rectangular floor panel, for example, having a width of less than 50 centimeters, are clamped on one or both short sides of the floor panel and herein protrude over a length of 100 centimeters and are not supported, the floor panels will bend under the influence of their own weight, wherein this bending at the height of the free extremity in respect to the clamped extremity is minimum 10 centimeters. For this bending, a bending time of 10 seconds is taken into account, and wherein the floor panel starts from a flat horizontal position.

Also, the invention primarily shows its advantages best when being applied in floor panels of the WPC type ("Wood Plastics Composite").

It is clear that the coupling parts in free condition preferably show a somewhat overlapping shape, such that the floor panels in coupled condition are seated in each other with a so-called "pretension".

The present invention is in no way restricted to the embodiment described herein above and represented in the figures, on the contrary may such floor panel be realized in various forms and dimensions, without leaving the scope of the invention.

So, for example, it is noted that, although in FIG. 1 an oblong floor panel is represented, the invention may also be applied to square floor panels.

It is also noted that by an "upward-directed" locking element not only a locking element is understood which extends in height in respect to the lip of the lower hook-shaped part. By this, also a locking element is understood which extends in the height in respect to a recess which is provided in this lip and which thus does not necessarily extend higher than the lip, with the exception of this recess.

It is noted that by a "downward movement" not only a movement is understood having only a downward component. By this, also a so-called fold-down movement is understood, as well as a movement which, besides a substantially downward component, for example, also comprises a lateral component.

It is noted that by "locking surfaces" not only surfaces are understood which, in the coupled condition of two floor panels, in fact come into contact. By this, also surfaces are understood which only make contact when the one floor panel is moving upward in respect to the other floor panel, for example, under the influence of external forces, and which consequently also allow at least a locking in vertical direction.

It is noted that "planing and/or scraping treatments" have to be interpreted broadly as linear cutting movements by which a thin layer can be removed from a surface. More particularly, by "planing and/or scraping treatments", broach and/or broaching treatments have to be understood.

The invention claimed is:

1. A floor panel comprising a substrate of synthetic material and a top layer which comprises a decorative layer and a translucent or transparent wear layer, wherein the floor panel comprises first coupling parts on a first pair of opposite edges allowing to couple two of such floor panels together by means of a downward movement thereby establishing a locking in horizontal and vertical direction, wherein the floor panel comprises second coupling parts on a second pair of opposite edges allowing to couple two of such floor panels together by means of a turning movement thereby establishing a locking in horizontal and vertical direction, wherein the first coupling parts are formed in one piece from the synthetic material of the substrate, wherein the first coupling parts comprise a downward-directed upper hook-shaped part on one of the first pair of opposite edges and an upward-directed lower hook-shaped part on the other of the first pair of opposite edges, wherein the upper hook-shaped part comprises a lip with a downward-directed locking element and the lower hook-shaped part comprises a lip with an upward-directed locking element, wherein each of the downward-directed and upward-directed locking elements is provided with a locking surface which takes part in the locking in vertical direction in coupled condition of two of such floor panels, the locking surfaces respectively being located at the proximal side of the downward-directed and upward-directed locking elements, wherein the locking surfaces are situated in the lower half of the panel, wherein the downward-directed locking element has a distal side, wherein the distal side of the downward-directed locking element is free from locking parts that in the coupled position of two such floor panels provide locking in vertical direction to prevent the two of such floor panels in the coupled position from disengaging in the direction perpendicular to the surface of the coupled panels, wherein the lip of the upper hook-shaped part has a lower side located proximally from the downward-directed locking element comprising a surface that runs inclinedly downward in a proximal direction, and wherein said surface runs inclinedly downwards from a position in the upper half of the panel to a position in the lower half of the panel.

2. The floor panel of claim 1, wherein the locking surfaces define a tangent line in coupled condition of two of such floor panels forming an angle with a plane of the floor panel of less than 90 degrees.

3. The floor panel of claim 1, wherein the downward-directed locking element has a distal side comprising a vertical surface and an inclined surface which is connected to the vertical surface.

4. The floor panel of claim 1, wherein the floor panel has a thickness of less than 6 mm.

5. The floor panel of claim 1, wherein the substrate is made of thermoplastic material.

6. The floor panel of claim 5, wherein the thermoplastic material includes polyvinyl chloride.

7. The floor panel of claim 1, wherein the floor panel comprises a reinforcement layer formed of glass fibers.

8. The floor panel of claim 7, wherein the reinforcement layer is located at the height of the locking surfaces.

9. The floor panel of claim 1, wherein the decorative layer is a printed film or printed foil.

* * * * *